United States Patent [19]

Naylor et al.

[11] Patent Number: 4,630,882

[45] Date of Patent: Dec. 23, 1986

[54] LOW PROFILE SCREW TERMINAL BLOCK WITH SPLIT PLASTIC BARREL

[75] Inventors: Herbert C. Naylor, West Dundee, Ill.; Gregory J. Smith, North Attleboro, Mass.; Howard J. Roeser, Jr., Wheaton, Ill.

[73] Assignee: Reed Devices, Inc., Carol Stream, Ill.

[21] Appl. No.: 692,933

[22] Filed: Jan. 18, 1985

[51] Int. Cl.[4] ..... H01R 9/24

[52] U.S. Cl. ..... 339/198 R; 339/263 R

[58] Field of Search ..... 339/198 R, 198 H, 198 G, 339/198 GA, 198 P, 198 S, 263 R, 198 E

[56] References Cited

U.S. PATENT DOCUMENTS

| | | | |
|---|---|---|---|
| 2,990,534 | 6/1961 | Nielsen | 339/198 GA |
| 3,325,774 | 6/1967 | Tucker | 339/263 R |
| 4,099,826 | 7/1978 | Mazzeo et al. | 339/198 R |
| 4,180,305 | 12/1979 | Ustin et al. | 339/198 H |
| 4,236,778 | 12/1980 | Hughes et al. | 339/198 H |

FOREIGN PATENT DOCUMENTS

| | | | |
|---|---|---|---|
| 0243651 | 9/1960 | Australia | 339/198 R |

OTHER PUBLICATIONS

Augat RDI Catalog No. 203, "*A Fresh Approach to Barrier Terminal Blocks*", pp. 1–32, by Reed Devices Inc., Carol Stream, Ill. 60188, Copyright 1981.

*Primary Examiner*—Gil Weidenfeld
*Assistant Examiner*—Thomas M. Kline
*Attorney, Agent, or Firm*—Weingarten, Schurgin, Gagnebin & Hayes

[57] ABSTRACT

A low profile screw terminal block is provided with a split plastic barrel which serves to prevent screw strip-out and to anchor the terminal screw when the terminal screw is pressed into the barrel and is advanced so as to form corresponding self-tapping threads in the smooth barrel, thereby to leave the terminal screw in a raised position ready for immediate wire insertion, to prevent the screw from vibrating loose during assembly and shipping and to securely hold the screw when the screw is tightened against a wire. The terminal block may be mounted to a fixed panel or like structure through the utilization of the split barrel at the end sections of the block by either a bolt running through the split channel and through the fixed panel or by a self-tapping machine screw inserted up through the fixed panel and into the split channel, with the split barrel design permitting overtightening without damage.

8 Claims, 13 Drawing Figures

LOW PROFILE SCREW TERMINAL BLOCK WITH SPLIT PLASTIC BARREL

FIELD OF INVENTION

This invention relates to terminal blocks and, more particularly, to a low profile terminal block designed utilizing a split integral barrel.

BACKGROUND OF THE INVENTION

Prior art terminal blocks have been used extensively in the electronics field to provide electrical contacts for use in the field as well as during factory manufacture. These blocks generally include a block of material with a row of metal inserts, with each metal insert having a threaded portion adapted to receive a screw. These threaded metal portions are usually in the form of an extruded tube and are relatively thin, with the remainder of the insert being bent transverse to the plane of the tube and inserted into a slot in the terminal block. The remainder of the insert usually includes a downwardly-depending pin which is insertable in a mating through hole in a fixed panel or a printed circuit board.

Problems with the prior art terminal block are that the insert stamping contours are difficult to control, both in fabrication and assembly, and that there are no provisions made for surface mounting of the block without additional or special molded components or hardware. Additionally, if the terminal blocks are provided for shipment with the screws inserted into the tube, the screws sometimes vibrate loose. Moreover, when overtightened, the screws strip the threads in the relatively thin tube making the terminal unusable. Additionally, because the tube is originally tapped for a predetermined size screw, only screws of this size may be utilized, whereas it may be desirable to use screws of a slightly different thread diameter or style in a particular application.

SUMMARY OF THE INVENTION

The subject screw-type terminal block is intended to not only serve as a basic, low cost block but also to provide certain functional features which prevent screw stripout, hold the screws in place during shipping and permit the mounting of a block to an associated printed circuit board or fixed panel without the need for additional hardware. The subject terminal block is suitable for both factory and field-wired applications, with a low profile design utilizing a molded plastic terminal block and, in one embodiment, copper alloy terminals. Moreover, they may employ either binding head or special wire clamp-plate machine screws. The plastic terminal block is molded incrementally to lengths dictated by various market needs.

As a specialized feature, the low profile screw terminal block is provided with a split plastic barrel which serves to initially anchor the terminal screw of the terminal screw assembly when the terminal screw is passed into the barrel and is advanced so as to form corresponding threads in the smooth barrel, thereby to leave the terminal screw in a raised position ready for immediate wire insertion, to prevent the screw from vibrating loose during assembly and shipping, and to securely hold the screw when the screw is tightened against a wire. Note that mating threads are formed inside the barrel once the screw is tightened, with the self-tapping aspect of the subject invention helping to retain the screw terminal assembly in the plastic terminal block.

The terminal block may be mounted to a fixed panel, a printed circuit board or like structure through the utilization of the split barrel at the end sections of the block, with these sections being left vacant so that the block may be secured to the fixed panel by either a bolt running through the split channel and through the fixed panel or by a self-tapping machine screw inserted up through the fixed panel and into the split channel. For overtightening control, the split barrel design permits the barrel to "breathe," spreading to allow the formed plastic threads in the barrel to "skip over" those on the metal screw, thereby permitting the screw to be loosened slightly and then retightened properly with no significant damage to the thread arrangement. This same split barrel design therefore resists thread stripout during surface mounting such that, if the terminal screw is inadvertently overtightened, the threads initially formed in the plastic by the screw do not strip out.

Additionally, one of the features unique to the subject terminal block design is the recessed lip tubular well and barrel integrally molded at each terminal position which provides postassembly support for the terminal. The recess provides a nest for an upper terminal flange provided with the terminal screw assembly to resist the twisting moment of screw tightening torque. Moreover, the narrow slotted opening, including the recess, both guides and supports the screw terminal during initial assembly.

The molded split barrel is important because, during assembly as each screw terminal assembly is pressed into position on the terminal block, the screw is driven only far enought to allow the first few threads to engage the inside diameter of the molded split plastic barrel. This not only prevents the screw from vibrating loose during assembly and shipping but permits the screw to remain in a raised position, ready for immediate wire insertion when reaching the customer. Later, as the screw is tightened against the wire, the threads on the screw from mating threads inside the split barrel. Once tightened, this self-threading aspect tends to help retain the terminal in the plastic terminal block. Thus, unlike the prior art terminal blocks, the mechanical stability of the screw/block connection is established not only by threads in the tube portion of the screw terminal assembly but, more importantly, mechanical stability is obtained by the self-tapping aspect of the plastic barrel into which the screw is inserted.

In addition to the initial screw terminal mounting feature described above, the integrally molded split barrel is designed to serve as a means for attaching the terminal block assembly to printed circuit boards or like assemblies where surface mounting is necessary.

By leaving each end terminal position vacant, this split tubular barrel provides adequate purchase for the threads of either standard machine thread-type or plastic thread-forming type mounting screws when the screws are driven from the bottom through a fixed panel and into the terminal block. It will therefore be appreciated that no separate inserts, nuts or special mounting hardware are required.

The split feature is important in its ability to resist thread stripout during the surface mounting described above. If the metal screw is inadvertently overtightened, the threads initially formed in the plastic by the screw do not strip out. Instead, the split design permits the barrel to breathe by spreading to allow the formed plastic threads in the barrel to skip over those on the metal screw. The screw may then be loosened slightly and then retightened properly, thereby providing an adequately snug mounting of the terminal block assembly with no significant damage to the thread arrangement.

The same molded split barrel permits surface mounting using the conventional bolt and nut combination, with the molded split barrel providing both guidance and support for an appropriate sized bolt. A washer and nut may be applied after the bolt is inserted from the top and fed through the terminal block and fixed panel, thereby completing the mounting.

The molded plastic terminal block is typically furnished in various lengths to accommodate market applications. The block may also be provided with half-thick end barriers to permit the butting of shorter length multiples of the terminal block without disrupting the continuity of uniform spacing between screw terminal positions.

The terminal insert is stamped and in the process of providing a tab having a screw-receiving extruded tube a center aperture is provided which permits more effective utilization of raw material while providing clearance for both the screw and the threaded extruded tube. In addition to conserving material, tests indicate that the two twin vertical legs or members produced by the stamping and resultant aperture provide additional surfaces which enhance the thermal dissipation of heat that may be generated when applying the rated current.

BRIEF DESCRIPTION OF THE DRAWINGS

These and other features of the subject invention may be better understood in connection with the detailed description taken in conjunction with the drawings of which.

DETAILED DESCRIPTION

Figure 1:
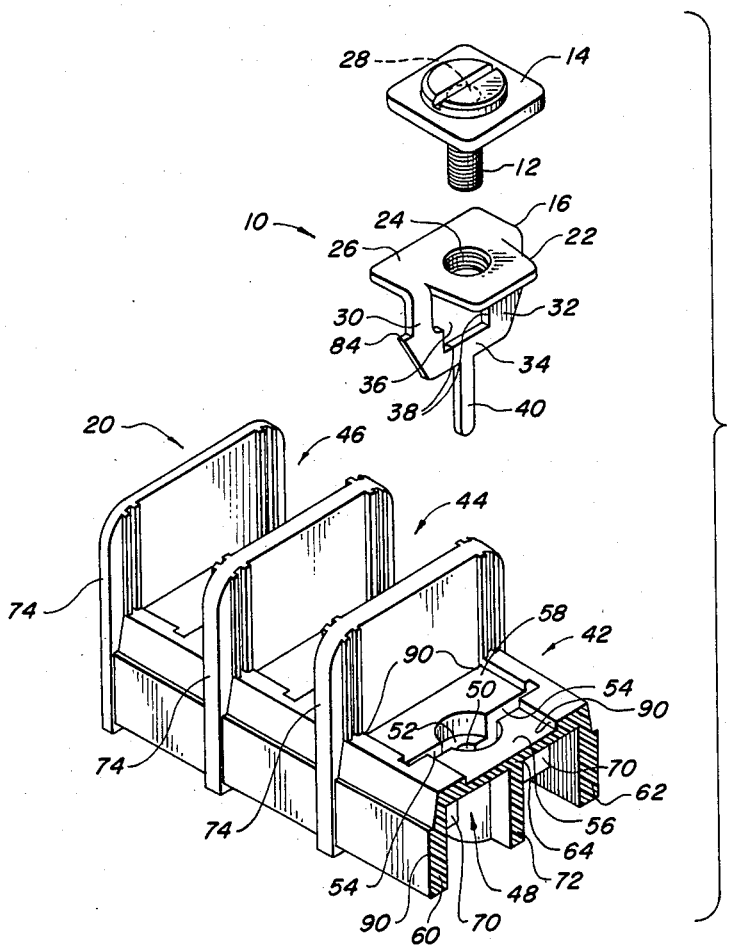
FIG. 1 is an exploded and diagrammatic view of the subject terminal block and screw terminal assembly, illustrating the slotted barrel in the terminal block.

Referring now to FIG. 1, a screw terminal assembly 10 is indicated as including a termination screw 12, with an integrally assembled wire-clamp plate 14 and a stamping which forms an insert 16 into a terminal block generally indicated by reference character 20. The insert includes a laterally-running tab portion 22 which has an extruded tube portion 24 that is tapped to receive the threads of screw 12. Insert 16 has a generally coplanar portion 26 opposite tab 22 which has a lateral extent corresponding to that of plate 14. Screw 12 may be carried in aperture 28 in plate 14 and is easily inserted into the screw threads of aperture 24.

The remainder of the insert formed by the stamping includes vertically-depending side members 30 and 32 and a horizontally-running bottom portion 34 with an open area 36 defined by the inner edges 38 of members 30, 32 and 34. The insert is completed, in one embodiment, with a downwardly-projecting pin or lead 40, with the vertical members 30 and 32 in combination with horizontally-running member 34 providing heat sink means for the dissipation of heat.

Terminal block 20 is provided with a number of terminal positions 42, 44 and 46, each of which includes a slotted barrel 48 adapted to receive a screw terminal assembly. Each of the positions includes a central bore 50 in barrel 48, a stepped portion 52 and a laterally-running groove 54 which extends through laterally-running supporting ribs 70 from the top surface of a recess 56 adapted to receive tab 22 of the screw terminal assembly, which top surface also corresponds to top surface 58 of an enlarged recess adapted to receive portion 26 of insert 16.

Barrel 48 is integrally formed in the terminal block which comprises side portions 60 and 62, and a top portion 64, with barrel 48 being secured to wall portions 60 and 62 via laterally-running ribs 70 which include the aforementioned slot completely therethrough. A longitudinally-running rib 72 supports barrel 48 in the longitudinal direction of the terminal block and is integrally attached at either end of the position to an upstanding wall portion 74 which is integrally formed with the terminal block and is utilized as a separator between terminal positions.

As will be explained hereinafter, slot 54 permits the barrel to expand slightly when a screw is advanced into position within the barrel. Barrel 48, as illustrated in FIG. 2, has smooth interior wall portions 76 into which screw 12 is advanced such that screw 12 forms a self-tapping arrangement, whereby the threads 78 of screw 12 form corresponding threads in barrel 48 when the screw is screwed down into the position shown in FIG. 2.

Figure 2:
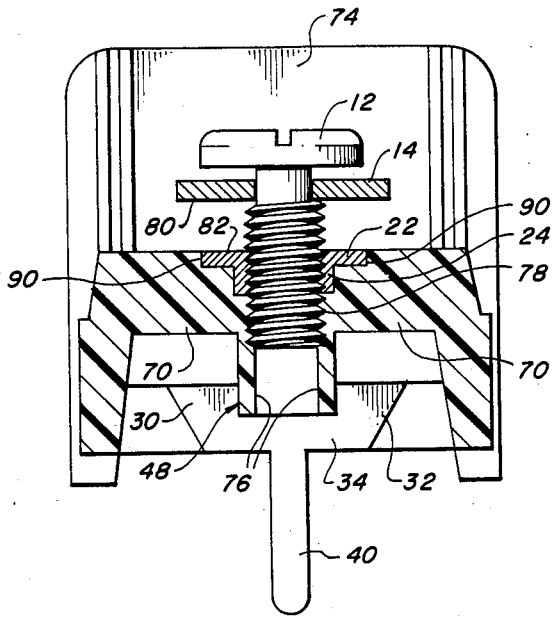
FIG. 2 is a cross-sectional diagram of the terminal block of FIG. 1 illustrating the self-tapping aspect of the terminal screw in the slotted barrel.

As can be seen from the FIG. 2 embodiment, during assembly, screw 12 is only partially advanced into position such that it and plate 14 are in a raised position during shipment, thereby to permit the insertion of a wire or other type of connector between the bottom surface 80 of plate 14 and the top surface 82 of insert 16.

As shown in this figure, ribs 70 are integrally formed with the body of block 20, with the block generally being made of a flame retardant thermoplastic, such as polyamide or polyester.

The self-tapping aspect of the subject terminal block and screw terminal assembly combination provides for not only the raised assembled structure shown in FIG. 2 but also assures that screw 12 will not be removed via vibration during shipping. Moreover, the self-tapping aspect also increases the mechanical stability of the contact when screw 12, with intervening wire (not shown), is screwed down into the terminal block since the self-threading continuous throughout barrel 48 such that it is not only the threading of extruded tube 24 which secures the screw to the insert; but it is also the self-threading of the screw into the barrel which strengthens the entire assembly.

Figure 3:
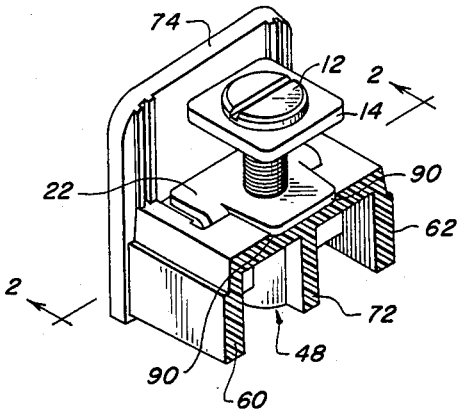
FIG. 3 is a diagrammatic and cross-sectional view of a portion of a completed terminal block of FIG. 1 for one position.

Referring to FIG. 3, an isometric view of the portion of the completed terminal block is shown in which like reference characters are utilized between FIGS. 1, 2 and 3.

Referring back to FIG. 1, it will be appeciated that vertical members 30 and 32 have outwardly projecting teeth 84 which engage the end walls of channel 54 such that, once the insert is pressed into the barrel and corresponding channel, it is locked in place within the terminal block.

Referring back again to FIG. 1 and FIG. 2, note that recesses 56 and 58 are provided with rounded edges 90 such that, when the insert is pressed into the terminal block, the narrowed slotted opening which the recess provides both guides and supports the screw terminal assembly when the insert is forced into the terminal block. The recesses formed in the terminal block resist the twisting moment of the screw tightening torque, thereby providing an overall rigid assembly.

Figure 4:
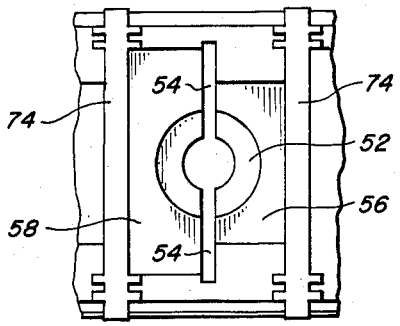
FIG. 4 is a top view of one position of the terminal block of FIG. 1.
Figure 5:
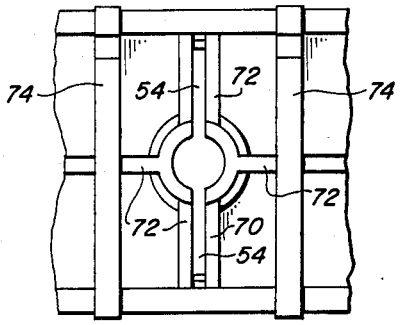
FIG. 5 is a bottom view of one position of the terminal block of FIG. 1.

Referring to FIGS. 4 and 5, a top and a bottom view of a portion of the terminal block 20 are illustrated, with slot 54 being seen to run across the recessed and barreled terminal block, with recesses 56, 58 and seat 52 being clearly in evidence in FIG. 4, along with divider portion 74 on either side of the terminal position.

With respect to the bottom view of FIG. 5, it will be appreciated that laterally-running ribs 70 contain slot 54. Note also that the longitudinally-running ribs 72 are integrally formed with the bottom portions of separators 74.

Figure 6:
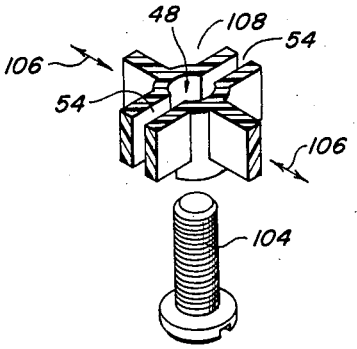
FIG. 6 is a diagrammatic illustration of the "breathing" of the split barrel when a machine screw is inserted and tightened into the split barrel.
Figure 7:
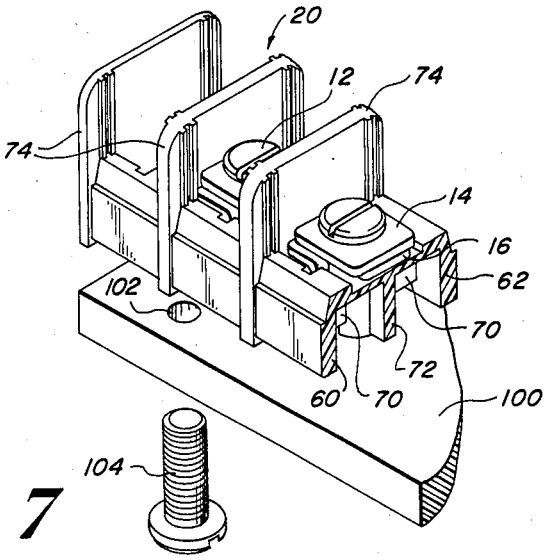
FIG. 7 is a diagrammatic illustration of the mounting of the terminal block of FIG. 1 on a fixed panel.

Referring now to FIGS. 6 and 7, what is shown in FIG. 7 is the mounting of terminal block 20 to a fixed plate or integrated circuit board 100 through the simple expedient of providing an aperture 102 in the board and providing a machine screw 104 which projects up through aperture 102 and into the barrel at one end of the terminal block, which barrel is not provided with any screw terminal assembly inserts.

Referring to FIG. 6, a portion 108 of the barrel is indicated as receiving screw 104 which, due to slot 54, permits limited expansion of barrel 48 in the direction of arrows 106 as screw 104 is advanced into the barrel.

Figure 8:
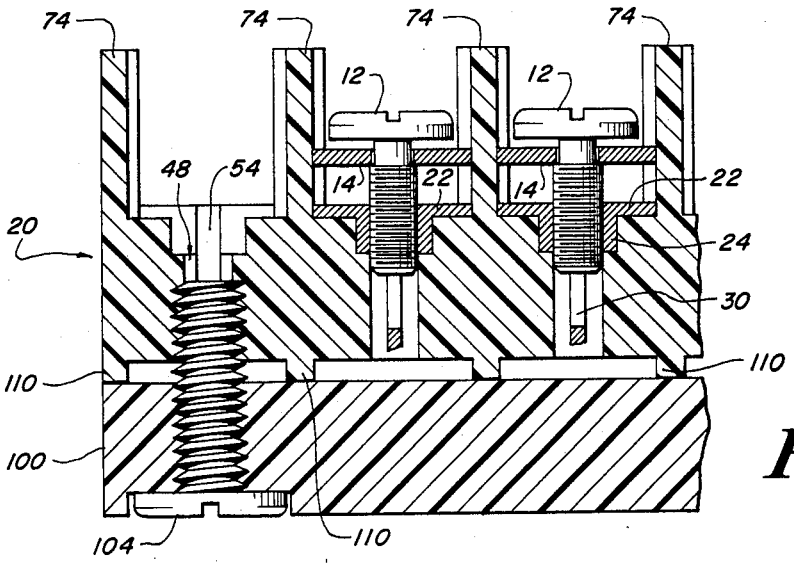
FIG. 8 is a cross-sectional view of the terminal block of FIG. 1, illustrating the mounting of the terminal block to a fixed panel utilizing a self-tapping screw comping up from the bottom of the fixed panel.

The result of the mounting is shown in FIG. 8 in which screw 104 self-taps into barrel 48 thereby to mechanically connect block 20 to fixed panel 100.

Should machine screw 104 be overtightened, barrel 48 is allowed to expand by virtue of channel 54 so that barrel is said to "breathe," spreading to allow the formed plastic threads in the barrel to "skip over" those on the metal screw 104. If the screw is overtightened, it may be backed off or loosened slightly and then retightened properly with no significant change to the thread arrangement originally provided by the initial advancing of screw 104 into barrel 48.

As an additional point, it will be appreciated that terminal block 20 may be provided with standoffs 110 to permit heat dissipation or for other purposes as desired, such as flushing chemical solutions during post-solder wave operations.

Figure 9:
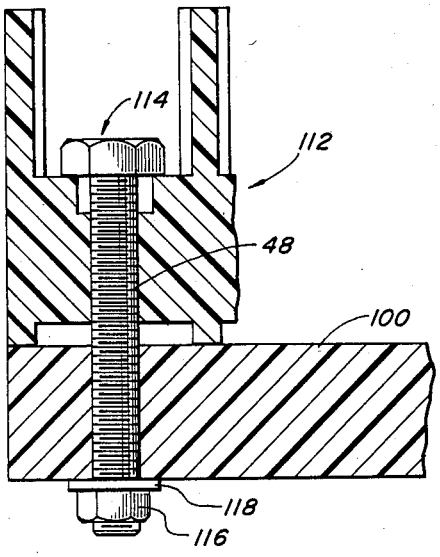
FIG. 9 is a cross-sectional view of the subject terminal block illustrating the mounting of the subject terminal block to a fixed panel, with a nut and bolt structure.

Referring now to FIG. 9, a portion 112 of block 20 is illustrated in which barrel 48 is provided with a bolt 114 which projects through the barrel and through panel 100 where it is secured beneath panel 100 by a nut 116 and washer 118 which indicates the adaptability of the mounting of the subject terminal board to virtually any type of substrate without the utilization of additional hardware or inserts.

Figure 10:
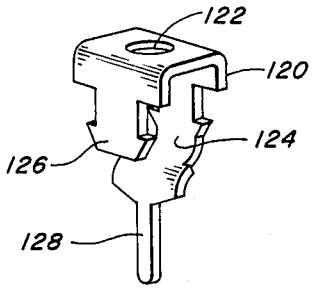
FIG. 10 (PRIOR ART)
FIG. 10 is a diagrammatic illustration of a prior art insert for a prior art terminal block.
Figure 11:
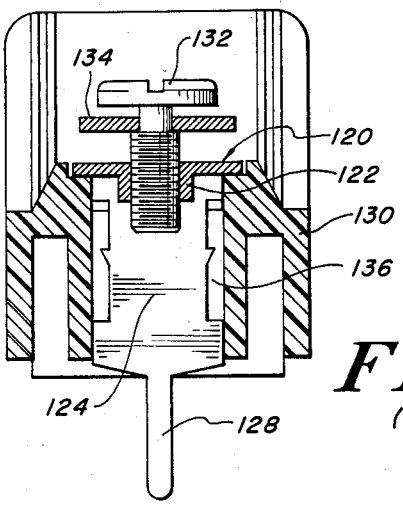
FIG. 11 (PRIOR ART)
FIG. 11 is a cross-sectional diagram of a prior art terminal block illustrating the screw being secured to the terminal via the insert of FIG. 10.

Referring to FIG. 10, a prior art insert 120 is illustrated as having a threaded tube 122 and a solid vertical portion 124 to one side of the tube with a vertical and toothed portion 126 to the other side of the aperture. This insert is also provided with a lead 128 as is common.

The insert is mounted into a terminal block generally indicated by reference character 130 with the usual terminal screw 132, plate 134 and insert 120 inserted into a generally square recess 136 such that lead 128 projects from the bottom thereof.

What will be apparent from this figure is that the sole method of securing screw 132 to the insert is via the threads within the insert, there being no self-threading of a plastic barrel or any barrel associated with this prior art terminal block. Moreover, flat surface 124 is seen as not having an open area as is the case in the subject case which, while satisfactory for certain purposes, does not provide an increased area heat sink as does the open area left by tab 22 in the subject invention.

Figure 12:
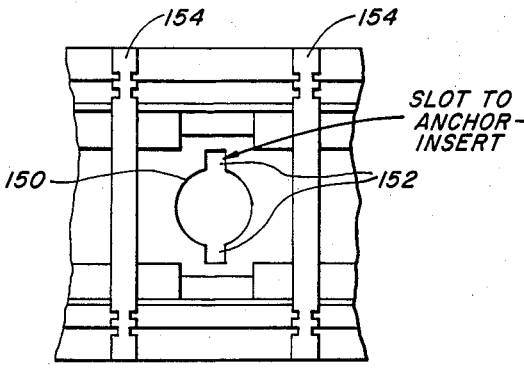
FIG. 12 (PRIOR ART)
FIGS. 12 and 13 are, respectively, top and bottom illustrations of the prior art terminal block of FIG. 11, illustrating a slot used to anchor the insert of FIG. 10 to the prior art terminal block of FIG. 11, as opposed to providing any mechanical support for the terminal screw used in the prior art block.
Figure 13:
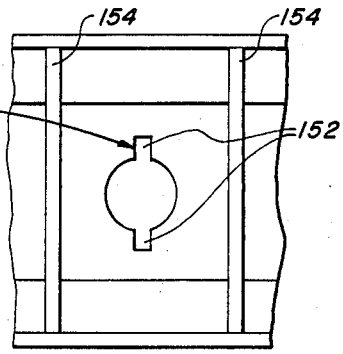
FIG. 13 (PRIOR ART)

Referring to FIG. 12, the top view of the prior art board is indicated as having a slotted aperture 150 with slots 152 being merely to accommodate the vertically-running portion of the insert of FIG. 10, which slots anchor the insert to the block, but which serve no barrel or slotted barrel function. In FIG. 12 the dividers are illustrated at 154 and run through to the bottom as illustrated in FIG. 13. Again, as seen from the bottom, the slotted aperture 152 shows no barrel configuration and therefore cannot provide the advantages mentioned hereinbefore.

Having above indicated a preferred embodiment of the present invention, it will occur to those skilled in the art that modification and alternative can be practiced within the spirit of the invention. It is accordingly intended to define the scope of the invention only as indicated in the following claims:

What is claimed is:

1. A terminal block comprising in combination:

a unitary block having a plurality of screw terminal assembly insert positions, each position including a slotted barrel, said block including at each insert position ribs supporting said barrel, a pair of said ribs including slots which communicate with the slot of said slotted barrel; and at least one screw terminal assembly including a screw and an insert, said insert including a laterally-running tab with an extruded tube and a vertically-running portion;

said slotted barrel being adapted to receive the insert portion of said screw assembly and the distal end of said screw, said vertically-running portion of said insert being inserted into said slotted barrel such that said vertically-running portion is held in position in the slot of said slotted barrel.

2. The terminal block of claim 1 wherein the top surface of said block adjacent a barrel includes a recess to receive said tab when said assembly is mounted to said block.

3. The terminal block of claim 2 wherein said recess has chamfered edge to guide said tabe and said insert.

4. The terminal block of claim 1 wherein all but the end positions of said block are provided with screw terminal assemblies.

5. The terminal block of claim 1 wherein said block and barrel are made of a plastic material which is self-tapped when a screw is advanced therein, said slot protecting against stripout during overtightening.

6. The terminal block of claim 5 wherein said screw is advanced into said barrel only a few turns such that said screw is raised above said tab, thereby to permit rapid contact with an electrical conductor placed between said screw and said tab and whereby said screw does not vibrate loose during shipping.

7. The terminal block of claim 1 wherein said vertically-running portion has an open area to permit increased heat sink capabilities for said insert.

8. The terminal block of claim 1 wherein said vertically-running portion includes outwardly projecting teeth for securing said insert in said slot.

* * * * *

UNITED STATES PATENT AND TRADEMARK OFFICE

CERTIFICATE OF CORRECTION

PATENT NO. : 4,630,882

DATED : December 23, 1986

INVENTOR(S) : Herbert C. Naylor; Gregory J. Smith; Howard J. Roeser, Jr.

It is certified that error appears in the above-identified patent and that said Letters Patent is hereby corrected as shown below:

Column 1, line 58, "passed" should read --pressed--

Column 2, line 40, "from" should read --form--

Column 3, line 57, "comping" should read --coming--

Column 5, line 9, "continuous" should read --continues--

Column 5, line 66, "change" should read --damage--

Column 6, line 20, "The insert" should read --This insert--

Column 7, line 9, "tabe" should read --tab--

Signed and Sealed this

Third Day of May, 1988

*Attest:*

DONALD J. QUIGG

*Attesting Officer*

*Commissioner of Patents and Trademarks*